US011739580B2

(12) United States Patent
Rapp et al.

(10) Patent No.: US 11,739,580 B2
(45) Date of Patent: Aug. 29, 2023

(54) HINGE ARRANGEMENT

(71) Applicant: SACS Aerospace GmbH, Empfingen (DE)

(72) Inventors: Andreas Rapp, Dornhan (DE); Roland Moser, Obernheim (DE)

(73) Assignee: SACS Aerospace GmbH, Empfingen (DE)

( * ) Notice: Subject to any disclaimer, the term of this patent is extended or adjusted under 35 U.S.C. 154(b) by 0 days.

(21) Appl. No.: 17/167,594

(22) Filed: Feb. 4, 2021

(65) Prior Publication Data

US 2021/0238903 A1 Aug. 5, 2021

(30) Foreign Application Priority Data

Feb. 4, 2020 (DE) ..... 102020201318.7

(51) Int. Cl.
*E05F 3/20* (2006.01)
*E05D 3/02* (2006.01)
*E05F 3/14* (2006.01)

(52) U.S. Cl.
CPC ..... *E05F 3/20* (2013.01); *E05D 3/02* (2013.01); *E05F 3/14* (2013.01); *E05Y 2201/212* (2013.01); *E05Y 2201/41* (2013.01); *E05Y 2201/484* (2013.01); *E05Y 2900/602* (2013.01)

(58) Field of Classification Search
CPC ..... E05F 3/20; E05F 3/02; E05F 3/14; E05F 3/12; E05Y 2201/212; E05Y 2201/41; E05Y 2201/484; E05Y 2201/266; E05Y 2201/256; E05Y 2900/602
See application file for complete search history.

(56) References Cited

U.S. PATENT DOCUMENTS 3,994,096 A * 11/1976 Holmgren ..... E04D 13/035 49/379
5,152,189 A * 10/1992 Miura ..... F16F 9/145 464/24
6,464,052 B1 * 10/2002 Hsiao ..... F16F 9/14 188/293

(Continued)

FOREIGN PATENT DOCUMENTS

DE 29808910 U1 8/1998
DE 10305977 A1 9/2004

(Continued)

*Primary Examiner* — Victor D Batson
*Assistant Examiner* — Matthew J Sullivan
(74) *Attorney, Agent, or Firm* — Hoffmann & Baron, LLP

(57) ABSTRACT

A hinge arrangement having a first hinge part and having a second hinge part, which are connected to one another such that they can pivot, a first hinge pin being formed on the first hinge part, on which a first hinge sleeve is pivotably mounted, which forms a first sliding bearing with the first hinge pin, a dimensionally stable support part being connected to the first hinge sleeve. A first axial protrusion is formed on a first axial end face of the first hinge pin, which engages in an arcuate first groove of the first hinge sleeve, wherein a circumferential first side wall of the first groove together with the first axial end face and an inner side of an end cover fixed at the end of the first hinge sleeve delimits a working space which is filled with a damping fluid for damping a relative movement of the first axial protrusion with respect to the first groove.

5 Claims, 5 Drawing Sheets

(56) References Cited

U.S. PATENT DOCUMENTS

| | | | | |
|---|---|---|---|---|
| 6,687,921 | B1 * | 2/2004 | Li | A47K 13/12 4/236 |
| 8,096,393 | B2 * | 1/2012 | Saito | F16F 9/145 188/293 |
| 8,167,100 | B2 * | 5/2012 | Chen | F16F 9/145 188/290 |
| 8,745,820 | B2 * | 6/2014 | Janak | E05F 3/12 188/290 |
| 8,898,860 | B2 * | 12/2014 | Bacchetti | E05D 3/02 16/303 |
| 9,353,565 | B2 * | 5/2016 | Bacchetti | E05F 3/104 |
| 9,492,041 | B1 * | 11/2016 | Liang | F16F 9/44 |
| 10,041,559 | B2 * | 8/2018 | Mihara | F16F 9/14 |
| 10,221,910 | B2 * | 3/2019 | Mihara | F16F 9/516 |
| 10,626,947 | B2 * | 4/2020 | Mihara | E05D 11/00 |
| 11,072,958 | B2 * | 7/2021 | Kuramochi | E05F 3/14 |
| 11,274,483 | B2 * | 3/2022 | Benedetti | E05F 3/12 |
| 2002/0078529 | A1 * | 6/2002 | Schwarz | E05F 3/20 16/387 |
| 2003/0204935 | A1 * | 11/2003 | Kim | E05F 3/20 16/280 |
| 2018/0238092 | A1 * | 8/2018 | Feng | E05F 3/14 |
| 2019/0040665 | A1 * | 2/2019 | Jean | E05D 11/082 |
| 2021/0095510 | A1 * | 4/2021 | Lee | E05F 1/1215 |
| 2021/0180381 | A1 * | 6/2021 | Wu | E05F 3/20 |
| 2021/0207417 | A1 * | 7/2021 | Koo | E05F 1/1215 |
| 2022/0049535 | A1 * | 2/2022 | Yoshida | F16F 9/16 |
| 2022/0106824 | A1 * | 4/2022 | Iijima | E05F 3/20 |

FOREIGN PATENT DOCUMENTS

| | | | |
|---|---|---|---|
| DE | 202011106729 | U1 | 1/2013 |
| EP | 0742381 | A2 | 11/1996 |
| EP | 2574714 | A2 | 4/2013 |

* cited by examiner

HINGE ARRANGEMENT

BACKGROUND OF THE INVENTION

The invention relates to a hinge arrangement having a first hinge part and having a second hinge part which is connected pivotably to the first hinge part, a first hinge pin (moon) protruding from the first hinge part along a hinge axis, and wherein a first hinge sleeve is pivotably mounted on the first hinge pin and forms a first sliding bearing with the first hinge pin, wherein a dimensionally stable support part is connected to the first hinge sleeve.

Such a hinge arrangement may be used, for example, to pivotally support a container lid on a container, the container being, for example, a waste container.

SUMMARY OF THE INVENTION

The task of the invention is to provide a hinge arrangement of the type mentioned above, which enables damping of the relative movement between the first hinge part and the second hinge part.

This task is solved for a hinge arrangement of the type mentioned above with the following features.

According to the invention a first axial protrusion protrudes from a first axial end face of the first hinge pin, which first axial protrusion engages in an arcuately formed first groove which is formed in the first hinge sleeve, wherein a circumferential first side wall of the first groove, together with the first axial end face and an inner side of an end cover fixed at the end of the first hinge sleeve delimits a working space in which a damping fluid is accommodated which is designed for damping a movement of the first hinge pin, which is provided with the first axial protrusion, relative to the first hinge sleeve.

By way of example, the arcuate first groove has, in a cross-sectional plane aligned transversely to the hinge axis, a profiling configured as a circular ring section.

The first axial protrusion likewise has, purely by way of example, a profiling in the form of a circular ring section in this cross-sectional plane. The first groove and the first axial protrusion are matched to one another in such a way that a pivoting movement of the first hinge part relative to the second hinge part can be carried out with a pivoting angle of, for example, 90 degrees.

In order to enable a damping of a relative movement between the first hinge part and the second hinge part, in the hinge arrangement according to the invention, a displacement of a damping fluid, which may be, for example, a silicone oil, takes place with the aid of the first axial protrusion, which moves in the arcuately formed first groove on an arcuate path about the hinge axis.

The first axial protrusion and the first groove are adapted to each other in such a way that at least one movement gap is formed between the first axial protrusion and a circumferential first side wall of the first groove, through which movement gap the damping fluid must flow in order to allow the relative movement between the first axial protrusion and the first groove.

A dimensioning of the at least one movement gap is to be adapted here to the properties, in particular the viscosity, of the preferably at least almost completely incompressible damping fluid, in order to achieve the desired limitation of a movement speed for the second hinge part relative to the first hinge part.

In order to prevent the damping fluid from escaping from the arcuately formed first groove there are, on the one hand, the first axial end face of the first hinge pin and the inner side of the end cover fixed at the end of the first hinge sleeve arranged adjacent to the circumferential first side wall of the first groove. This limits a working space in which the damping fluid is enclosed. This ensures that during the relative movement between the first hinge part and the second hinge part, the desired displacement effect for the damping fluid is ensured by the axial protrusion.

Alternatively to the above arrangement, it may be provided that the arcuately formed first groove is formed in the first axial end face of the first hinge pin and that the first axial protrusion of the associated with the first hinge sleeve and engages in this groove. This kinematic inversion of the above described arrangement of first axial protrusion and first groove realizes the same functionality. This also applies to the further embodiments described in the subclaims.

Advantageous further embodiments of the invention are the subject of the subclaims.

It is expedient if an annular seal is arranged between the end cover, in particular between the inner side of the end cover, and a first end face of the first hinge sleeve, which seal is designed to seal the working space. The annular seal is preferably made of a rubber-elastic material and can thus be elastically deformed to ensure the desired sealing effect between the inside of the end cover and the first end face of the first hinge sleeve. Preferably, a cross-section, in particular a round cross-section, of the annular seal is selected in such a way that a sealing effect between the end cap and the first hinge sleeve can be realized within a certain deformation interval for the seal. This ensures a fault-tolerant assembly of the end cover to the first hinge sleeve.

In a further development of the invention, it is provided that the end cover and the first hinge sleeve are each assigned mutually corresponding threaded sections which form a screw connection which is designed for fixing the end cover to the first hinge sleeve and for adjusting the distance of the end cover with respect to the first hinge sleeve. Preferably, it is provided that thread axes of the mutually corresponding thread sections of the end cover and the first hinge sleeve are each aligned along the hinge axis and a screw movement for this screw connection takes place coaxially to the hinge axis. The screw connection enables the end cover to be fixed to the first hinge sleeve, whereby a distance adjustment can be made by a screw movement between the end cover and the first hinge sleeve. This distance adjustment influences the elastic deformation of the annular seal arranged between the first end face of the first hinge sleeve (star) and the inside of the end cover and likewise influences the distance between the inside of the end cover and the first end face of the first hinge sleeve (star). With this distance adjustment, a cross-section of a movement gap available for the damping fluid changes. Accordingly, the damping behaviour of the hinge arrangement can be adjusted by this distance adjustment.

In a further embodiment of the invention, it is provided that the threaded portion of the end cap is integrally formed on the end cap. This makes it possible to manufacture the end cover at low cost, since additional sealing measures that would be required if a separate screw were used to fix the end cover can be omitted.

Preferably, it is provided that a first, radially inner movement gap with a first cross-sectional area is formed between the first axial protrusion and a first, outwardly facing wall portion of the circumferential side wall of the first groove and that a second, radially outer movement gap with a second cross-sectional area is formed between the first axial protrusion and a second, inwardly facing wall portion of the circumferential side wall of the first groove and that a third axially aligned movement gap with a third cross-sectional area is formed between the first axial end face of the first hinge pin and an opposite end face of the first hinge sleeve and that a fourth axially aligned movement gap with a second cross-sectional area is formed between an axial end face of the first axial protrusion and the inside of the end cover, which fourth axially aligned movement gap is formed with a fourth cross-sectional area dependent on an axial positioning of the end cover relative to the first end face of the first hinge sleeve. For example it is provided that the geometry of the first groove as well as the geometry of the first axial protrusion are selected such that the first, second and third cross-sectional areas do not change during a relative movement of the first hinge part with respect to the second hinge part. Alternatively, it can also be provided that the geometry of the first groove is selected such that during the relative movement of the first hinge part with respect to the second hinge part, a change in a distance between a first side surface of the first axial protrusion and the oppositely arranged first wall portion and/or a change in a distance between a second side surface of the first axial protrusion and the oppositely arranged second wall portion takes place. The related change in the first cross-sectional area and/or the second cross-sectional area which also takes place in this case thus also leads to a damping effect which is dependent on the pivot angle between the first hinge part and the second hinge part, as a result of which an angle-dependent movement behaviour of the second hinge part relative to the first hinge part can be prescribed.

Advantageously, the fourth cross-sectional area is adjustable between 0.1 times and 1.2 times a sum of the first cross-sectional area and of the second cross-sectional area and of the third cross-sectional area. By this variation of the fourth cross-sectional area, the desired adjustment of the damping behaviour of the hinge arrangement can be achieved.

It is expedient if a second axial protrusion is formed on the first axial end face of the first hinge pin, which second axial protrusion is arranged offset by 180 degrees relative to the first axial protrusion with respect to the hinge axis and which engages in an arcuately formed second groove which is formed in the first hinge sleeve and which second groove is arranged offset by 180 degrees relative to the first groove with respect to the hinge axis. In this way, a significant increase in the damping effect between the first hinge part and the second hinge part is realized in a compact installation space. Exemplarily, it is provided that the second groove and the second axial protrusion are formed identically to the first groove and the first axial protrusion with respect to their respective geometries. Alternatively, it may also be provided that deviations exist between the geometries of the first groove and the second groove and/or between the geometries of the first axial protrusion and the second axial protrusion in order to be able to induce specific damping characteristics.

In a further embodiment of the invention, it is provided that a second hinge pin is formed on the first hinge member (son), the second hinge pin extending along the hinge axis in a direction opposite to the first hinge pin, wherein a second hinge sleeve is pivotably mounted on the second hinge pin, which second hinge sleeve forms a second sliding bearing with the second hinge pin, wherein the dimensionally stable support part is formed for connecting the first hinge sleeve to the second hinge sleeve. This ensures advantageous, in particular symmetrical, force transmission between the first hinge part and the second hinge part, so that the hinge arrangement can also be used for high loads which may occur in furniture fittings or waste garbage cans.

Preferably, it is provided that the first hinge part is penetrated by a longitudinal bore extending along the hinge axis, in which a spring device is accommodated, which is connected in each case at the ends with the first hinge pin and with the second hinge sleeve. The task of the spring device is to determine a preferred position for the second hinge part relative to the first hinge part. For this purpose, it is provided that the spring device undergoes a change in an internal spring tension during a relative movement of the first hinge part with respect to the second hinge part, with the result that, depending on a direction of the pivoting movement, an output of energy by the spring device or a storage of energy in the spring device takes place. By arranging the spring device in the longitudinal bore of the first hinge part, a particularly compact design for the first hinge part can be realized. Furthermore, it is advantageous if a central axis of the spring device, which is typically in the form of a helical spring, is arranged coaxially with the hinge axis, since this enables symmetrical application of force to the spring device.

According to an advantageous further embodiment of the invention, it is provided that a sliding sleeve is arranged between the first hinge pin and the first hinge sleeve and/or that a sealing ring, in particular accommodated in a first carrier ring fixed in the first hinge sleeve, is arranged between the first hinge pin and the first hinge sleeve. The function of the sliding sleeve is to ensure a low sliding friction between a first outer surface of the first hinge pin and a first inner surface of the first hinge sleeve. Preferably, it is provided that the first hinge member and the secs and hinge member are each made of a metallic material, in particular aluminum. It is further provided that the sliding sleeve is made of a plastic material such as, for example, Polyoxymethylene (POM), which is also sold under the trade name Delrin, with which a bearing friction between the first hinge pin and the first hinge sleeve can be predetermined in a narrow interval. Supplementary or alternatively, it is provided that a sealing ring is arranged between the first hinge pin and the first hinge sleeve, which seals the working space in an axial direction away from the end cover, so that no leakage of damping fluid from the working space is possible in this region. Preferably, it is provided that the sealing ring, which can be designed in particular as an O-ring, is accommodated in a circumferential groove of a first carrier ring fixed in the first hinge sleeve. For example, the carrier ring is pressed into the hinge sleeve in a sealing manner and has the circumferential groove on its inner surface. The task of the carrier ring is to provide an advantageous contact surface for the sealing ring without this contact surface having to be manufactured in a complex manner on the inner surface of the first hinge sleeve (star).

BRIEF DESCRIPTION OF THE DRAWINGS

An advantageous embodiment of the invention is shown in the drawing. Here shows.

DETAILED DESCRIPTION OF THE PREFERRED EMBODIMENTS

Figure 1:
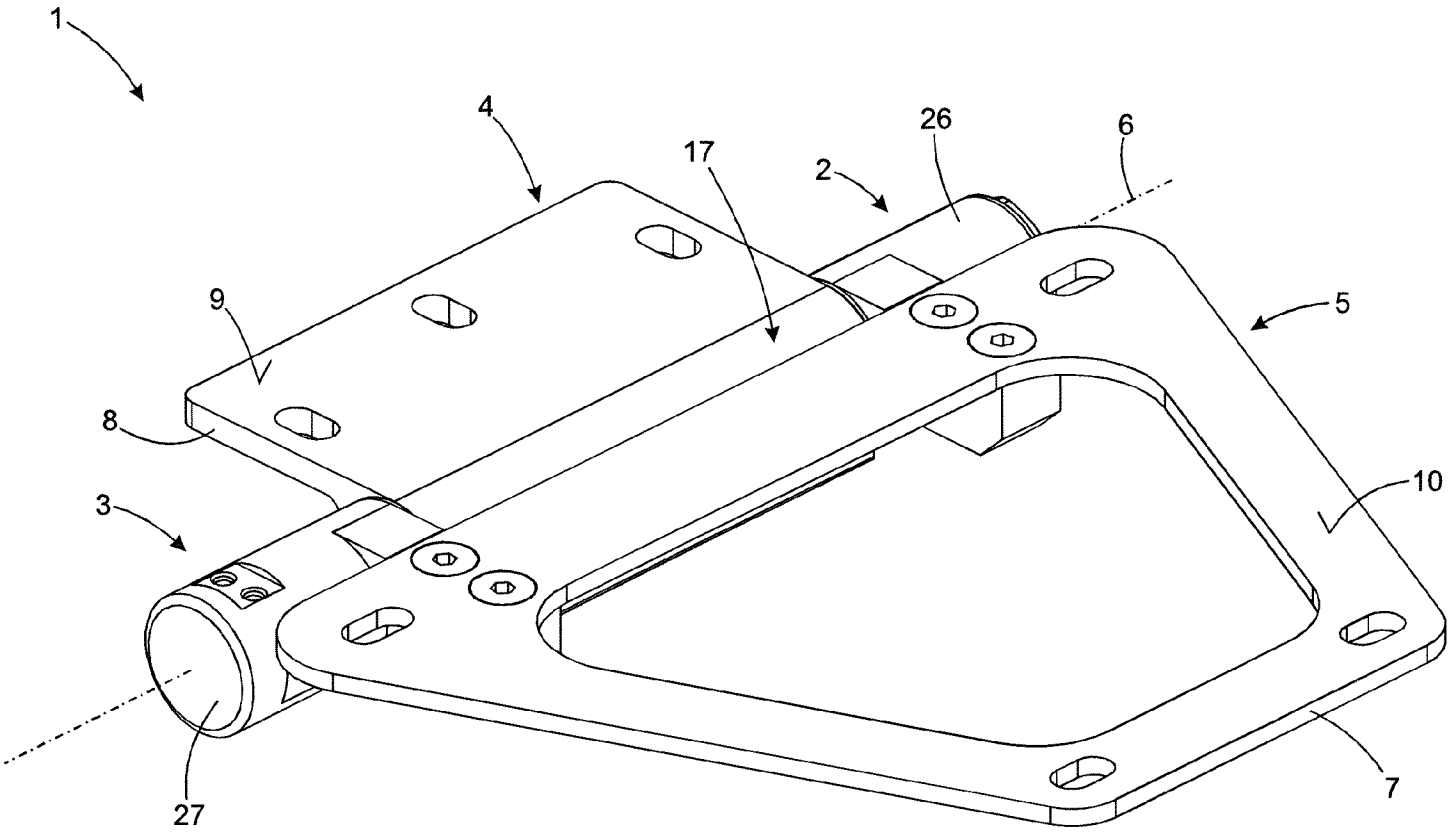
FIG. 1 a perspective overview view of a hinge assembly with a first hinge part and a second hinge part, FIG. 2 an exploded view of the hinge arrangement according to FIG. 1, FIG. 3 a detailed view of a first sliding bearing of the hinge arrangement according to FIGS. 1 and 2, FIG. 4 a front view of the first sliding bearing of the hinge arrangement with the end cap removed, and FIG. 5 a sectional view through the first sliding bearing.

A hinge arrangement 1 shown in FIG. 1 comprises, purely by way of example, a first sliding bearing 2 and a second sliding bearing 3, the two sliding bearings 2 and 3 each being designed as pivot bearings and permitting a pivoting movement between a first hinge part 4 and a second hinge part 5 about a hinge axis 6. As can be seen from the illustration of FIG. 2, the first sliding bearing 2 and the second sliding bearing 3 are connected to each other by means of a support part 7, for example by screw connections not specified in more detail, so that a synchronous pivoting movement for the first sliding bearing 2 and the second sliding bearing 3 is always ensured.

Exemplarily, it is provided that the first hinge part 4 comprises a fastening plate 8 which, purely exemplarily, has a flat fastening surface 9 and which is designed to be fixed to an item of equipment not shown in greater detail, for example to a throw-in opening of a waste container (not shown). Furthermore, it is exemplarily provided that the carrier part 7 has a flat fastening surface 10 which can be used for attaching a lid part not shown, with which, for example, the throw-in opening of the waste container (not shown) can be closed. The throw-in opening can be opened by a pivoting movement of the carrier part 7 and of the lid part, which is not shown and is attached thereto, about the hinge axis 6.

Figure 2:
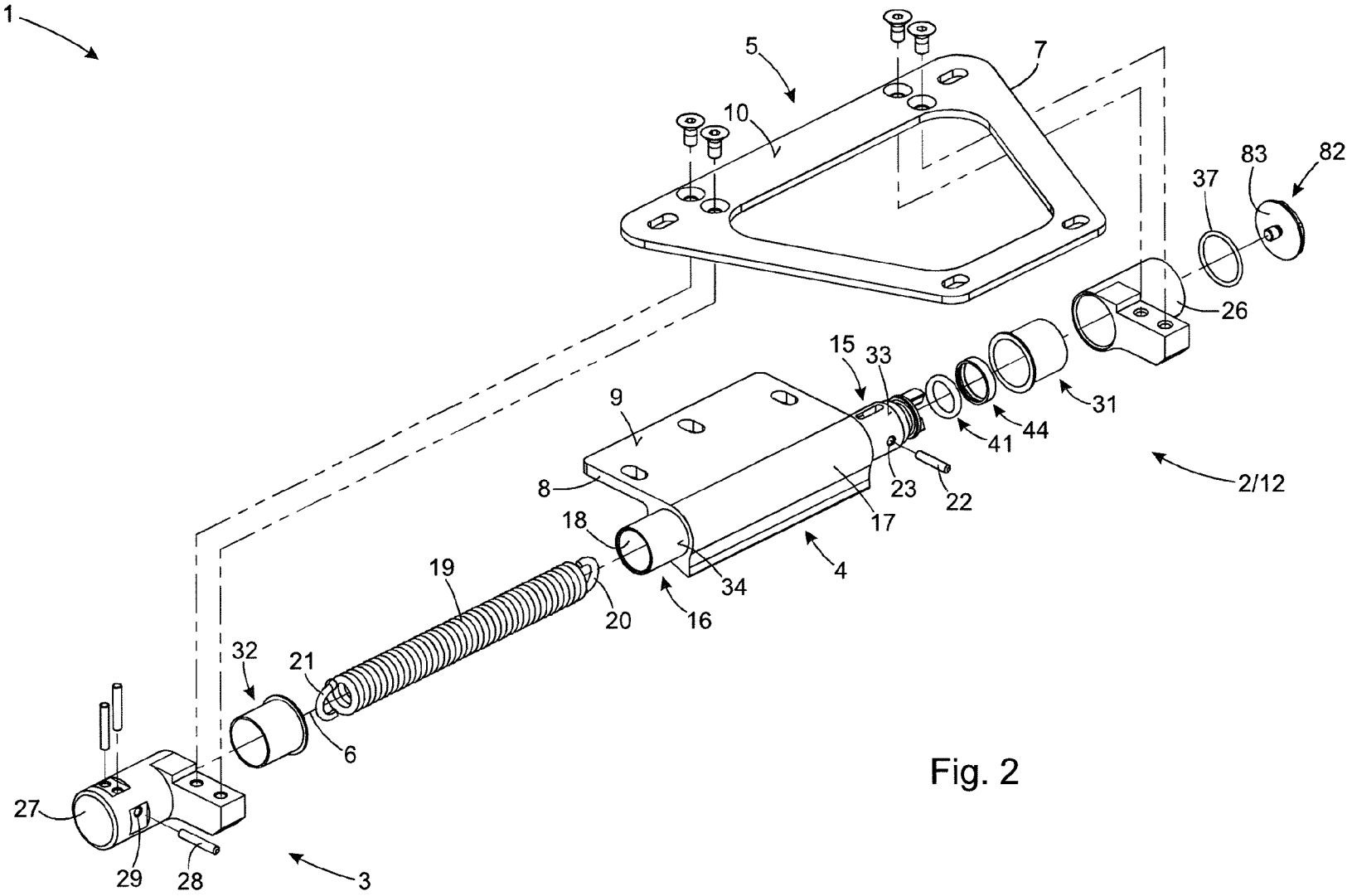

As can be seen from FIG. 2, the first hinge part 4 comprises a first hinge pin 15, which extends along the hinge axis 6 and is of substantially circular-cylindrical design, and a second hinge pin 16, which likewise extends along the hinge axis 6 and is arranged at a distance from the first hinge pin 15 and is designed as a circular-cylindrical sleeve. The two hinge pins 15 and 16 each project in opposite directions from a base body 17, which is designed purely exemplarily as a profiled body extending along the hinge axis 6 with a constant, in this case L-shaped, profiling. Each of the hinge pins 15, 16 is provided with a correspondingly designed first hinge sleeve 26 and second hinge sleeve 27, respectively to form the first sliding bearing 2 and the second sliding bearing 3.

By way of example, it is provided that the second hinge pin 16 and the base body 17 are penetrated by a longitudinal bore 18 which is aligned coaxially with the hinge axis 6 and which extends so far into the first hinge pin 15, that a semicircularly formed first end section 20 of a spring device formed as a helical spring 19 can be fixed in a rotationally fixed manner to the first hinge part 4 by means of a dowel pin 22, which can be pressed into a transverse bore 23 aligned transversely to the hinge axis 6.

It is further provided that the helical spring 19 extends into a receiving bore of the second hinge sleeve 27, which receiving bore which is not shown in greater detail and is aligned coaxially with the hinge axis 6 and is in the form of a blind hole. The second hinge sleeve 27 is associated with the second hinge pin 16 and the helical spring 19 can be connected with the second hinge sleeve 27 in a rotationally fixed manner by means of a dowel pin 28 which can be pressed into a transverse bore 29. Since the second hinge sleeve 27 is associated with the second hinge part 5, as will be described in more detail below, a pivoting movement of the second hinge part 5 relative to the first hinge part 4 initiates a torsional movement in the helical spring 19, whereby, depending on the direction of the pivoting movement, either a release of stored spring energy from the helical spring 19 or a storage of spring energy in the helical spring 19 takes place.

Purely by way of example, it is provided that the second hinge sleeve 27 is rotatably received on the second hinge pin 16, wherein to ensure an advantageous sliding bearing between the second hinge sleeve 27 and the second hinge pin 16 a second sliding sleeve 32 is provided, which is in sliding contact with the circular-cylindrical outer surface 34 of the second hinge pin (moon) 16 and with the circular-cylindrical inner surface, not shown in greater detail, of the second hinge sleeve (star) 27. Preferably, it is provided that the first hinge part 4 and the second hinge sleeve 27 are each made of a metallic material, in particular aluminum, and in that the second sliding sleeve 32 is made of a rigid plastic material.

The structure of the first sliding bearing 2 differs from the structure of the second sliding bearing 3 in that the first sliding bearing 2 has a damping device 12 described in more detail below. The task of the damping device 12 is to brake a pivoting movement between the first hinge part 4 and the second hinge part 5 and thus to enable a comfortable and safe pivoting movement of a second device part, not shown, attacked to the second hinge part 5 with respect to a first device part, also not shown, to which the first hinge part 4 is fixed.

Figure 3:
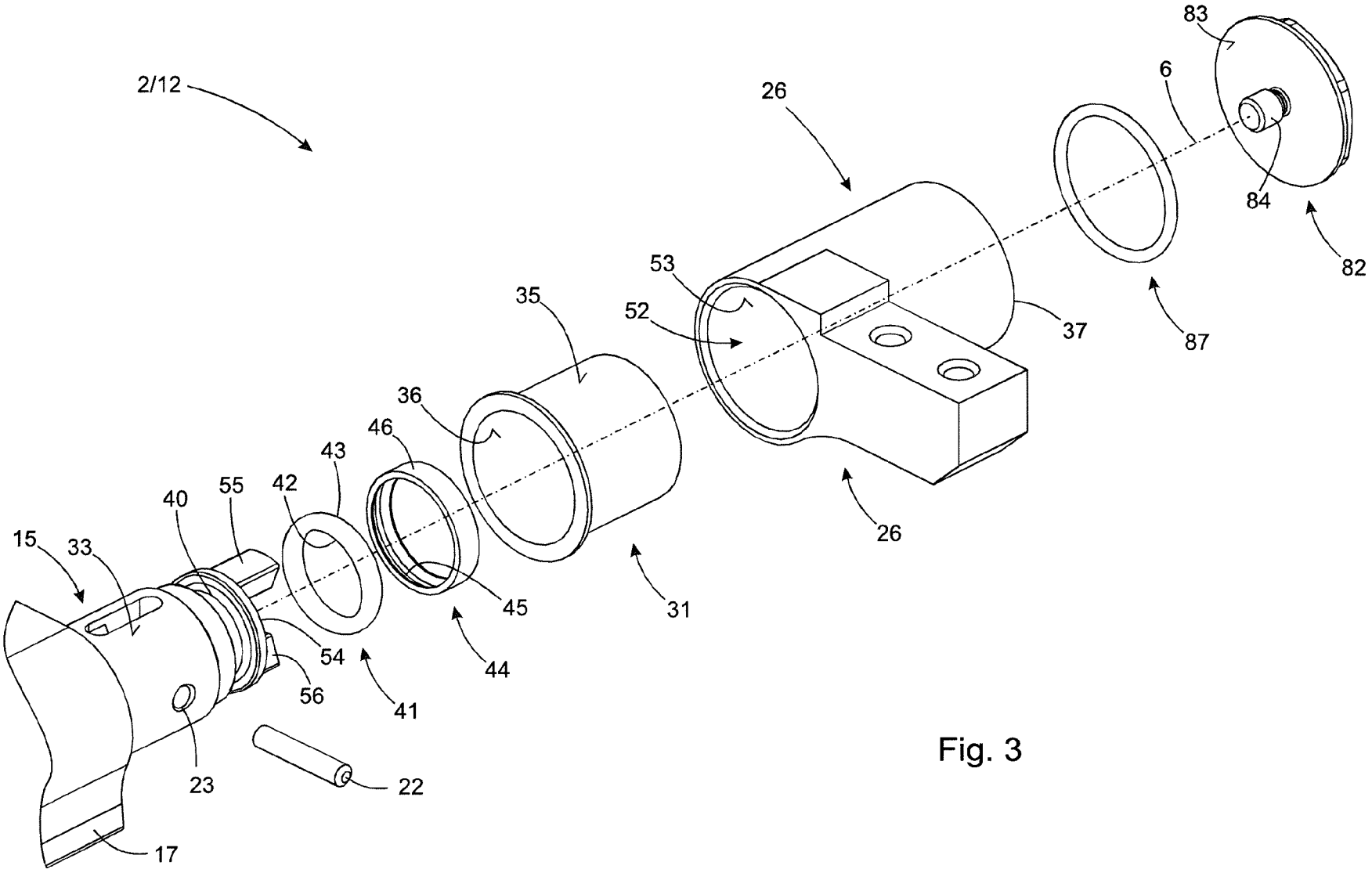
Figure 4:
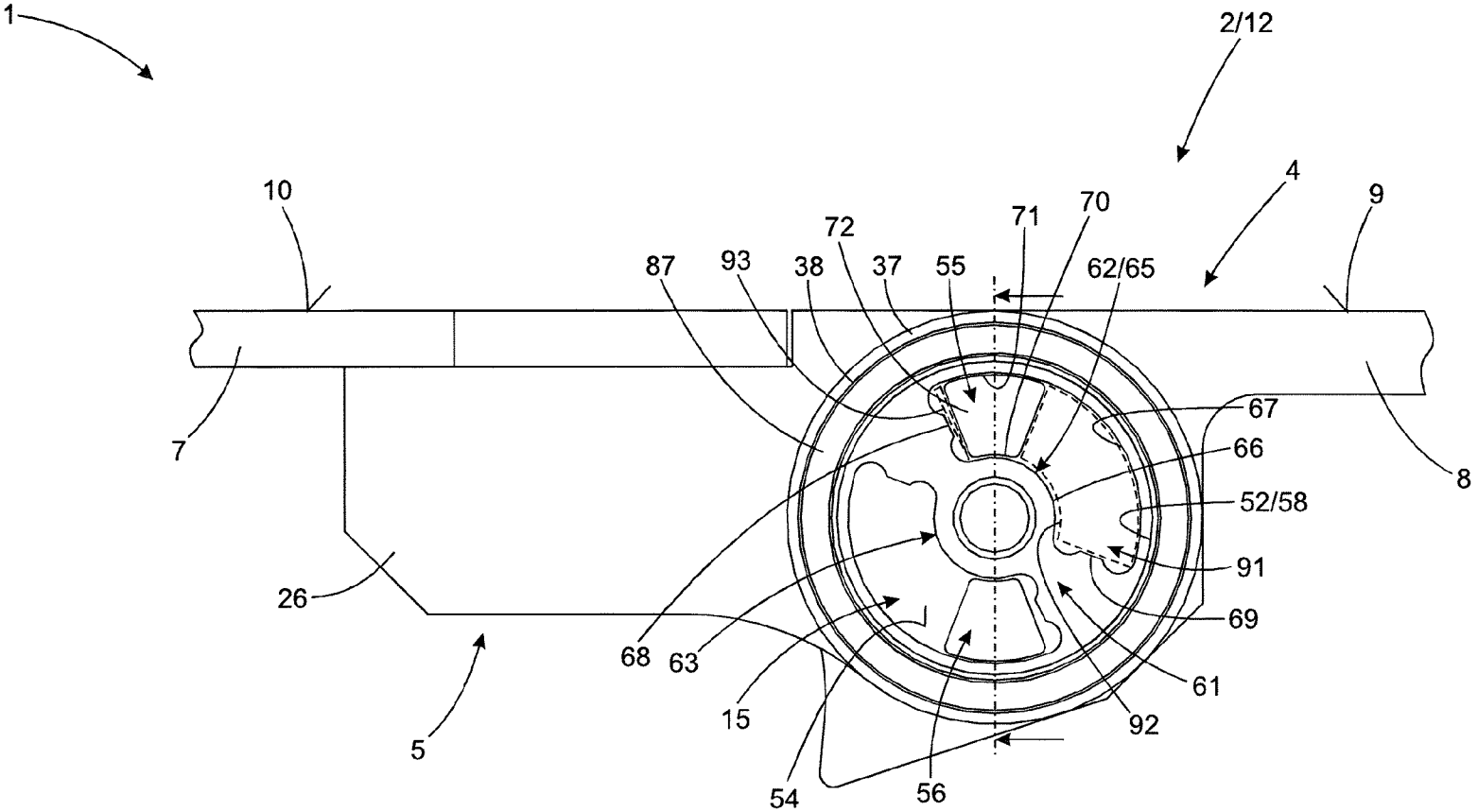
Figure 5:
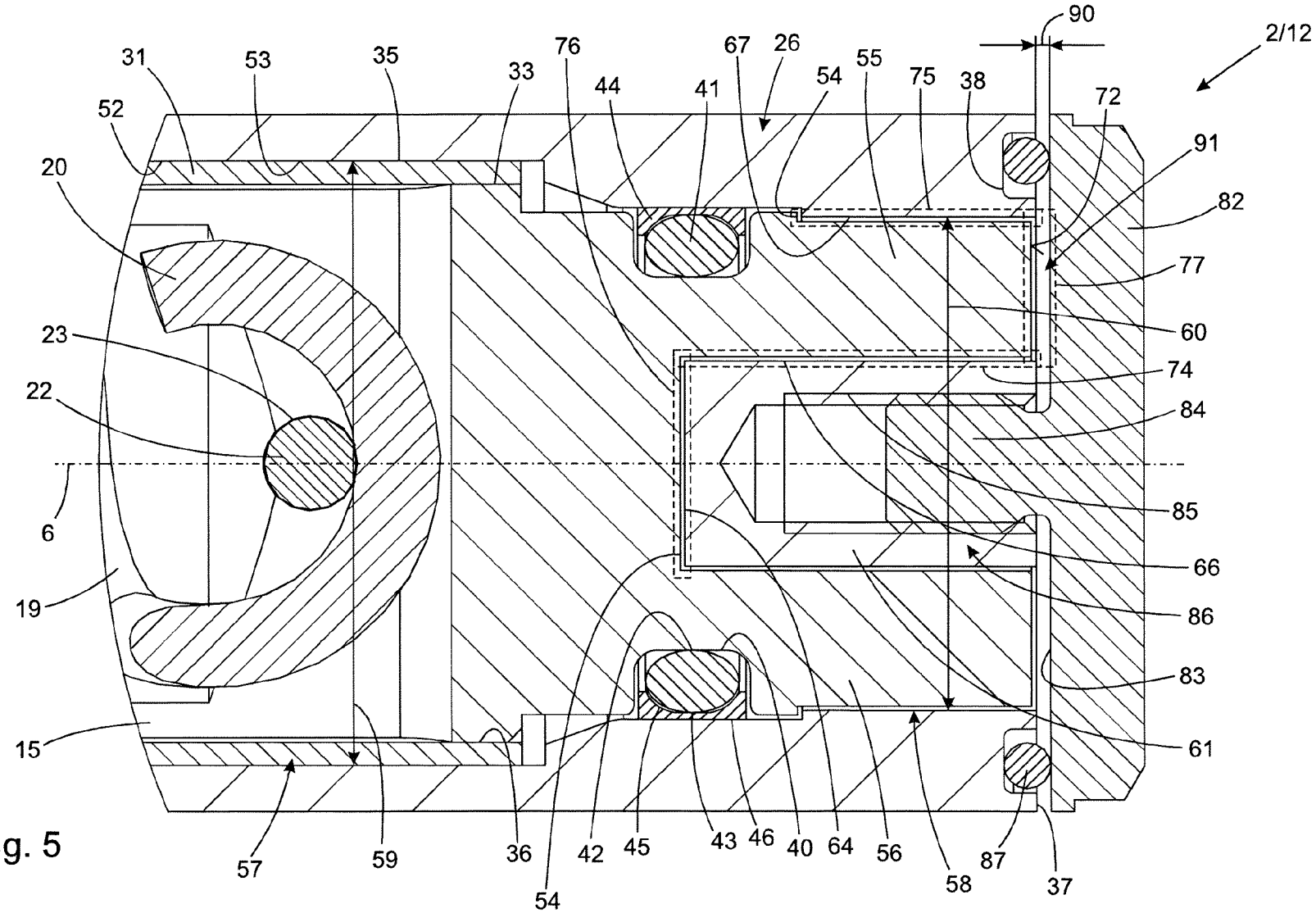

The components of the damping device 12 can be seen in the illustrations of FIGS. 3 to 5.

From the illustration of FIG. 3 it can be seen that the first hinge pin (moon) 15 is provided with an annular circumferential groove 40, which is designed to receive a first sealing ring 41, which is designed purely exemplarily as an O-ring and is made of a rubber-elastic material. The sealing ring 41 is thus provided to lie with its inner circumferential surface 42 sealingly in the groove 40 and with its outer circumferential surface 43 sealingly in an annular groove 45 of a carrier ring 44. As an example the carrier ring 44 has an annular geometry and is provided with a circular-cylindrical outer surface 46 for force-fit attachment to an inner surface 53 of a through-bore 52 of the first hinge sleeve (star) 26. Thereby, the through bore 52 extends with a purely exemplary circular cross-section along the hinge axis 6 through the first hinge sleeve 26. For an advantageous sliding bearing between the first hinge pin 15 and the first hinge sleeve 26, a first sliding sleeve 31 with a circular cross-section is provided, which bears with a circular-cylindrical outer surface 35 against the circular-cylindrical inner surface 53 of the first hinge sleeve 26 and which bears with a circular-cylindrical inner surface 36 against the circular-cylindrical outer surface 33 of the first hinge pin 15.

A first axial protrusion 55 and a second axial protrusion 56 are arranged on a first axial end face 54 of the first hinge pin 15, which is aligned transversely with respect to the hinge axis 6 and is of a planar design, wherein the axial protrusions 55, 56 extend along the hinge axis 6 in a spatial direction away from the second hinge pin 16. Exemplarily, the first axial protrusion 55 and the second axial protrusion 56 are formed point-symmetrically with respect to a point of symmetry that results from an intersection between the hinge axis 6 and the first axial end surface 54. As can be seen from the representation of FIG. 4, the first axial protrusion 55 and the second axial protrusion 56 each have a profiling in the form of a circular ring section in a cross-sectional plane aligned transversely to the hinge axis 6 and corresponding to the representation plane of FIG. 4. Purely by way of example, it is provided that the profiling of the first axial protrusion 55 and of the second axial protrusion 56, which is in the form of a circular ring section, each extends over an angular range of approx. 40 degrees.

As can be seen from the illustration of FIG. 5, the through bore 52 includes a first bore portion 57 having a first diameter 59 greater than a second diameter 60 of a second bore portion 58. It is further provided that a ridge 61 is formed in the second bore portion 58, which ridge 61 is also visible in FIG. 4 and extends along the second diameter 60. The ridge 61 forms with the second bore section 58 a first groove 62 and a second groove 63, each of which has a profiling in the form of a circular ring section in a cross-sectional plane aligned transversely to the hinge axis 6 and corresponding to the plane of representation of FIG. 4. Purely by way of example, it is provided that the profiling of the first groove 62 and the second groove 63, which is in the form of a circular ring section, each extends over an angular range of approx. 135 degrees.

By way of example, the geometric configuration of the first axial protrusion 55 engaging the first groove 62 and the second axial protrusion 56 engaging the second groove 63 described above enables the first hinge part 4 to pivot relative to the second hinge part 5 about the hinge axis 6 over an angular range of approximately 95 degrees.

The operation of the damping device 12 is described below with reference to the interaction between the first axial protrusion 55, the first groove 62 and a damping fluid not shown in detail, this operation being equally applicable to the interaction between the second axial protrusion 56, the second groove 63 and the damping fluid not shown in detail.

The first groove 62 has a circumferential first side wall 65 comprising a first, outwardly facing wall portion 66 and a second, inwardly projecting wall portion 67, both wall portions 66, 67 each having a circular arc portion-shaped pros filing in a cross-sectional plane oriented transversely to the hinge axis 6 and corresponding to the plane of representation of FIG. 4. The two wall sections 66, 67 are connected to each other by a first connecting section 68 and a second connecting section 69, respectively.

A first movement gap 74 shown in FIG. 4 is formed between an arc-sectionally profiled inner surface 70 of the first axial protrusion 55 and the first wall section 66. Furthermore, a second movement gap 75 is formed between an outer surface 71 of the first axial protrusion 55, which is profiled in the shape of an arc section, and the second wall section 67. In addition, an end surface 64 of the ridge 61 and the first axial end surface 54 form a third movement gap 76. A fourth movement gap 77 is formed between a first axial end surface 72 of the first axial protrusion 55 and an inner surface 83 of an end cover 82.

Purely by way of example, the end cover 82 is formed rotationally symmetrically with respect to the hinge axis 6 and comprises a threaded pin 84 extending along the hinge axis 6 from the exemplarily planar inner surface 83 aligned transversely with respect to the hinge axis 6, the threaded pin 84 being provided with an undesignated external thread. The external thread of the threaded pin 84 is provided for engagement in a threaded bore 85 which is made in the ridge 61 coaxially with the hinge axis 6 and which, together with the threaded pin 84, forms a screw connection 86. On the one hand, this screw connection 86 can be used to fix the end cover 82 to the first hinge sleeve 26. On the other hand, this screw connection 86 enables an adjustment of a distance 90 between the inner side 83 of the end cover 82 and a first end surface 37 of the first hinge sleeve 26. This distance adjustment also provides an adjustment of a cross-section of the fourth movement gap 77, whereby the characteristics of the damping device 12 can be influenced.

The operation of the damping device 12 is based on the fact that the first side wall 65 of the first groove 62 shown in FIG. 4, the first axial end face 54 of the first hinge pin 15 and the inner side 83 of the end cover 82 delimit a working space 91. In order to ensure a sealing effect between the inner side 83 of the end cover 82 and the first end face 37 of the first hinge sleeve 26 and thus seal the working space 91, a sealing ring 87 is provided which is arranged between the first end face 37 and the inner side 83. The sealing ring 87 is made of a rubber-elastic material and, purely by way of example, is accommodated in a circumferential groove 38 of the first end face 37 and, due to its elasticity, can ensure a sealing effect between the end cover 82 and the first hinge sleeve 26 over a certain distance interval.

On the one hand, the first axial protrusion 55 engages in the working space 91, and on the other hand, this working space 91 is preferably completely filled with a damping fluid which is not shown, for example a mineral or synthetic oil, in particular a silicone oil. Accordingly, during a relative movement between the first hinge part 4 and the second hinge part 5, a relative movement of the first axial protrusion 55 with respect to the first groove 62 also occurs. Since the working space 91 is preferably completely filled with the damping fluid, in order to perform this relative movement between the first axial protrusion 55 and the first groove 62, it is necessary for the damping fluid to be displaced by the first axial protrusion 55 from a first variable-size working space portion 92 and to flow into a second variable-size working space portion 93. Since the damping fluid can only flow through the movement gaps 74 to 77 in this case, which provide a considerable flow resistance for the damping fluid, the desired damping of the relative movement between the first hinge part 4 and the second hinge part 5 is ensured.

By adjusting the distance 90, the elastic deformation of the sealing ring 87 is changed on the one hand. On the other hand, this influences the cross-section for the fourth movement gap 77, so that a total cross-section available for a flow of the damping fluid, which can be determined on the basis of the individual cross-sections of the movement gaps 74 to 77, can be varied in order to influence the desired damping effect for the hinge arrangement 1.

The invention claimed is:

1. A hinge arrangement comprising a first hinge part and a second hinge part, said second hinge part being pivotably connected to the first hinge part, wherein a first hinge pin protrudes from the first hinge part along a hinge axis, and wherein a first hinge sleeve is pivotably mounted on the first hinge pin, which first hinge sleeve forms a first sliding bearing with the first hinge pin, the hinge arrangement further comprising a carrier part connected to the first hinge sleeve, wherein a first axial protrusion is formed on a first axial end face of the first hinge pin, which protrusion engages in an arcuately formed first groove formed in the first hinge sleeve, wherein a circumferential first side wall of the first groove, together with the first axial end face and an inner side of an end cover fixed at the end to the first hinge sleeve, delimits a working space in which a damping fluid is accommodated for damping a relative movement of the first hinge pin, which is provided with the first axial protrusion, with respect to the first hinge sleeve, and wherein a first radially inner movement gap with a first cross-sectional area is formed between the first axial protrusion and a first outwardly facing wall portion of the circumferential side wall of the first groove, and wherein a second, radially outer movement gap with a second cross-sectional area is formed between the first axial protrusion and a second, inwardly pointing wall section of the circumferential side wall of the first groove, and wherein a third, axially aligned movement gap with a third cross-sectional area is formed between the first axial end face of the first hinge pin and an opposite end face of the first hinge sleeve, and wherein a fourth, axially aligned movement gap with a second cross-sectional area is formed between an axial end face of the first axial protrusion and the inner side of the end cover, said axially aligned fourth movement gap being formed with a fourth cross-sectional area dependent on an axial positioning of the end cover.

2. The hinge arrangement according to claim 1, wherein the fourth cross-sectional area is adjustable between 0.1 times and 1.2 times a sum of the first cross-sectional area and the second cross-sectional area and the third cross-sectional area.

3. A hinge arrangement comprising a first hinge part and a second hinge part, said second hinge part being pivotably connected to the first hinge part, wherein a first hinge pin protrudes from the first hinge part along a hinge axis, and wherein a first hinge sleeve is pivotably mounted on the first hinge pin, which first hinge sleeve forms a first sliding bearing with the first hinge pin, the hinge arrangement further comprising a carrier part connected to the first hinge sleeve, wherein a first axial protrusion is formed on a first axial end face of the first hinge pin, which protrusion engages in an arcuately formed first groove formed in the first hinge sleeve, wherein a circumferential first side wall of the first groove, together with the first axial end face and an inner side of an end cover fixed at the end to the first hinge sleeve, delimits a working space in which a damping fluid is accommodated for damping a relative movement of the first hinge pin, which is provided with the first axial protrusion, with respect to the first hinge sleeve, and wherein a second hinge pin is formed on the first hinge part, which second hinge pin is extended along the hinge axis in a direction opposite to the first hinge pin, wherein a second hinge sleeve is pivotably mounted on the second hinge pin, which second hinge sleeve forms a second sliding bearing with the second hinge pin, and wherein a dimensionally stable support part is formed for connecting the first hinge sleeve to the second hinge sleeve, and wherein the first hinge part is penetrated by a longitudinal bore-extending along the hinge axis, in which longitudinal bore a spring device is accommodated, wherein end regions of the spring device are connected to the first hinge pin and the second hinge sleeve respectively.

4. A hinge arrangement comprising a first hinge part and a second hinge part, said second hinge part being pivotably connected to the first hinge part, wherein a first hinge pin protrudes from the first hinge part along a hinge axis, and wherein a first hinge sleeve is pivotably mounted on the first hinge pin, which first hinge sleeve forms a first sliding bearing with the first hinge pin, the hinge arrangement further comprising a carrier part connected to the first hinge sleeve, wherein a first axial protrusion is formed on a first axial end face of the first hinge pin, which protrusion engages in an arcuately formed first groove formed in the first hinge sleeve, wherein a circumferential first side wall of the first groove, together with the first axial end face and an inner side of an end cover fixed at the end to the first hinge sleeve, delimits a working space in which a damping fluid is accommodated for damping a relative movement of the first hinge pin, which is provided with the first axial protrusion, with respect to the first hinge sleeve, and wherein a first sliding sleeve is arranged between the first hinge pin and the first hinge sleeve and/or wherein a sealing ring is arranged in a first support ring fixed in the first hinge sleeve between the first hinge pin and the first hinge sleeve.

5. A hinge arrangement comprising a first hinge part and a second hinge part, said second hinge part being pivotably connected to the first hinge part, wherein a first hinge pin protrudes from the first hinge part along a hinge axis, and wherein a first hinge sleeve is pivotably mounted on the first hinge pin, which first hinge sleeve forms a first sliding bearing with the first hinge pin, the hinge arrangement further comprising a carrier part connected to the first hinge sleeve, wherein a first axial protrusion is formed on a first axial end face of the first hinge pin, which protrusion engages in an arcuately formed first groove formed in the first hinge sleeve, wherein a circumferential first side wall of the first groove, together with the first axial end face and an inner side of an end cover fixed at the end to the first hinge sleeve, delimits a working space in which a damping fluid is accommodated for damping a relative movement of the first hinge pin, which is provided with the first axial protrusion, with respect to the first hinge sleeve, and wherein an annular seal is arranged between the end cover and a first end face of the first hinge sleeve to seal the working space, and wherein the annular seal is arranged between an inner side of the end cover and the end face of the first hinge sleeve.

* * * * *